US008972159B2

(12) United States Patent
Ferreira et al.

(10) Patent No.: US 8,972,159 B2
(45) Date of Patent: Mar. 3, 2015

(54) METHODS AND SYSTEMS FOR COORDINATING VEHICULAR TRAFFIC USING IN-VEHICLE VIRTUAL TRAFFIC CONTROL SIGNALS ENABLED BY VEHICLE-TO-VEHICLE COMMUNICATIONS

(75) Inventors: Michel Celestino Paiva Ferreira, Oporto (PT); Ozan Tonguz, Pittsburgh, PA (US); Ricardo Jorge Fernandes, Oporto (PT); Hugo Marcelo Fernandes DaConceicao, Albergaria-a-Velha (PT); Wantanee Viriyasitavat, Pittsburgh, PA (US)

(73) Assignees: Carnegie Mellon University, Pittsburgh, PA (US); Universidade do Porto, Porto (PT)

( * ) Notice: Subject to any disclaimer, the term of this patent is extended or adjusted under 35 U.S.C. 154(b) by 0 days.

(21) Appl. No.: 13/809,925

(22) PCT Filed: Jul. 15, 2011

(86) PCT No.: PCT/US2011/044157

§ 371 (c)(1),
(2), (4) Date: Jan. 14, 2013

(87) PCT Pub. No.: WO2012/009620

PCT Pub. Date: Jan. 19, 2012

(65) Prior Publication Data

US 2013/0116915 A1 May 9, 2013

Related U.S. Application Data

(60) Provisional application No. 61/399,724, filed on Jul. 16, 2010.

(51) Int. Cl.
*G08G 1/00* (2006.01)
*G08G 1/16* (2006.01)

(52) U.S. Cl.
CPC ..... *G08G 1/00* (2013.01); *G08G 1/163* (2013.01); *G08G 1/164* (2013.01)
USPC ..... 701/117; 701/118; 701/119; 701/120; 701/301

(58) Field of Classification Search
CPC . G08G 1/00; G08G 1/0968; G08G 1/096855; G08G 1/096861; G08G 1/096866; G08G 1/0969; G08G 1/16; G08G 1/163; G08G 1/164; G08G 1/165; G08G 1/166; G08G 1/167; G08G 1/20; G08G 1/207
USPC ..... 701/117–120, 301
See application file for complete search history.

(56) References Cited

U.S. PATENT DOCUMENTS 6,246,954 B1 6/2001 Berstis et al.
6,339,381 B1 1/2002 Takikita (Continued)

FOREIGN PATENT DOCUMENTS

EP 0911788 A2 4/1999

OTHER PUBLICATIONS

International Search Report and Written Opinion dated Nov. 7, 2011, for related PCT/US2011/044157 filed Jul. 15, 2011.

(Continued)

*Primary Examiner* — Mary Cheung
*Assistant Examiner* — Atul Trivedi
(74) *Attorney, Agent, or Firm* — Downs Rachlin Martin PLLC

(57) ABSTRACT

Systems, methods, software, and apparatuses for coordinating traffic proximate to a potential conflict zone, such as a roadway intersection, where travel conflicts, such as crossing traffic, can arise. Coordination involves forming an ad-hoc network in a region containing the conflict zone using, for example, vehicle-to-vehicle communications and developing a dynamic traffic control plan based on information about vehicles approaching the conflict zone. Instructions based on the dynamic traffic control plan are communicated to devices aboard vehicles in the ad-hoc network, which display one or more virtual traffic signals to the operators of the vehicles and/or control the vehicles in accordance with the dynamic traffic control plan.

73 Claims, 7 Drawing Sheets

(56) References Cited

U.S. PATENT DOCUMENTS

| | | | | |
|---|---|---|---|---|
| 7,636,117 | B2 | 12/2009 | Schnaithmann | |
| 7,647,180 | B2 | 1/2010 | Breed | |
| 8,478,642 | B2 * | 7/2013 | Dey et al. | 705/14.4 |
| 8,615,354 | B2 * | 12/2013 | Barker et al. | 701/117 |
| 2003/0154017 | A1 * | 8/2003 | Ellis | 701/117 |
| 2004/0158390 | A1 | 8/2004 | Mukaiyama | |
| 2006/0095199 | A1 * | 5/2006 | Lagassey | 701/117 |
| 2006/0142933 | A1 * | 6/2006 | Feng | 701/117 |
| 2006/0291473 | A1 * | 12/2006 | Chase et al. | 370/395.5 |
| 2007/0008927 | A1 * | 1/2007 | Herz et al. | 370/331 |
| 2007/0118280 | A1 * | 5/2007 | Uhlmann et al. | 701/208 |
| 2008/0095134 | A1 | 4/2008 | Chen et al. | |
| 2008/0234920 | A1 * | 9/2008 | Nurminen | 701/117 |
| 2008/0252485 | A1 * | 10/2008 | Lagassey | 340/907 |
| 2009/0063030 | A1 * | 3/2009 | Howarter et al. | 701/117 |
| 2009/0198440 | A1 | 8/2009 | Shiraki et al. | |
| 2010/0020169 | A1 * | 1/2010 | Jang et al. | 348/115 |
| 2010/0185382 | A1 * | 7/2010 | Barker et al. | 701/119 |
| 2010/0256836 | A1 * | 10/2010 | Mudalige | 701/2 |
| 2011/0035141 | A1 * | 2/2011 | Barker et al. | 701/119 |
| 2011/0144896 | A1 * | 6/2011 | Howarter et al. | 701/117 |

OTHER PUBLICATIONS

Ching-Ling Huang et al., "Adaptive intervehicle communication control for cooperative safety systems" IEEE Network, IEEE Service Center, New York, NY, XP011287978, ISSN: 0890-8044, vol. 24, No. 1, Jan. 1, 2010, pp. 6-13.

Jeffrey Miller Ed et al., "Vehicle-to-vehicle-to-infrastructure (V2V2I) intelligent transportation system architecture", Intelligent Vehicles Symposium, 2008 IEEE, XP031318946, ISBN: 978-1-4244-2568-6; Jun. 4, 2008, pp. 715-720.

* cited by examiner 5A
5B

METHODS AND SYSTEMS FOR COORDINATING VEHICULAR TRAFFIC USING IN-VEHICLE VIRTUAL TRAFFIC CONTROL SIGNALS ENABLED BY VEHICLE-TO-VEHICLE COMMUNICATIONS

RELATED APPLICATION DATA

This application claims the benefit of priority of U.S. Provisional Patent Application Ser. No. 61/399,724, filed on Jul. 16, 2010, and titled "Methods, Apparatuses, and Systems for In-Vehicle Traffic Lights Enabled by Vehicle-to-Vehicle Communications," which is incorporated by reference herein in its entirety.

FIELD OF THE INVENTION

The present invention generally relates to the field of vehicular traffic control. In particular, the present invention is directed to methods and systems for coordinating vehicular traffic using in-vehicle virtual traffic control signals enabled by vehicle-to-vehicle communications.

BACKGROUND

The use of traffic lights, (also known as stoplights, traffic lamps, traffic signals, and other related terms) to control traffic flow at intersections is a long-standing means to promote traffic safety and efficiency. While traffic lights and intersection-based signs are the predominant means of controlling traffic flow, other methods of intersection-based traffic management have been the subject of some experimentation.

SUMMARY OF THE DISCLOSURE

In one implementation, the present disclosure is directed to a method of coordinating vehicular traffic proximate to a potential travel-priority conflict zone. The method includes communicating with at least one dynamic traffic control system located on-board a vehicle proximate to the potential travel-priority conflict zone so as to establish a dynamic traffic control plan for avoiding a travel-priority conflict in the potential travel-priority conflict zone; and coordinating with the at least one dynamic traffic control system via the communicating to elect a dynamic traffic controller as a temporary coordinator vehicle responsible for temporarily coordinating the dynamic traffic control plan.

In another implementation, the present disclosure is directed to a machine-readable storage medium containing machine-executable instructions for performing a method of coordinating vehicular traffic proximate to a potential travel-priority conflict zone. The machine-executable instructions comprising: a first set of machine-executable instructions for communicating with at least one dynamic traffic control system located on-board a vehicle proximate to the potential travel-priority conflict zone so as to establish a dynamic traffic control plan for avoiding a travel-priority conflict in the potential travel-priority conflict zone; and a second set of machine-executable instructions for coordinating with the at least one dynamic traffic control system via the communicating to elect a dynamic traffic controller as a temporary coordinator vehicle responsible for temporarily coordinating the dynamic traffic control plan.

In still another implementation, the present disclosure is directed to a system for coordinating vehicular traffic proximate to a potential travel-priority conflict zone. The system includes a vehicle-to-vehicle communications system; a processor in operative communication with the vehicle-to-vehicle communication system; and memory in operative communication with the processor, the memory containing machine-executable instructions for execution by the processor and comprising: a first set of machine-executable instructions for communicating with at least one dynamic traffic control system located on-board a vehicle proximate to the potential travel-priority conflict zone so as to establish a dynamic traffic control plan for avoiding a travel-priority conflict in the potential travel-priority conflict zone; and a second set of machine-executable instructions for coordinating with the at least one dynamic traffic control system via the communicating to elect a dynamic traffic controller as a temporary coordinator vehicle responsible for temporarily coordinating the dynamic traffic control plan.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

This disclosure addresses, in part, methods and systems for coordinating vehicular traffic in a region containing a potential-travel-priority-conflict zone using an ad-hoc vehicle-based network facilitated by vehicle-to-vehicle (V2V) communications. In this context, V2V communications enable development of a dynamic traffic control plan ("DTCP") that can resolve a travel-priority conflict in the potential-conflict zone which, if left unresolved, could result in a collision. Generally, a DTCP includes a set of travel instructions that are communicated to vehicles participating in the ad-hoc network for the particular potential-conflict zone. For example, these instructions can include a sequence by which vehicles approaching from different directions may proceed through a potential-conflict zone, the speed at which vehicles approaching a conflict zone should be traveling, and so forth. One important aspect of a DTCP is that the instructions are tailored for the specific vehicles participating in conflict, and are also coordinated with the other vehicles participating in the conflict so as to resolve the conflict without incident. Additionally, this coordination can assist with optimizing vehicle flow through a potential-travel-priority conflict zone as a function of traffic volume, road conditions, as well as other characteristics of travel routes and participating vehicles. The systems and methods described herein do not require intersection-based or road-based infrastructure to resolve such priority conflicts. Instead, the systems and methods of the present disclosure rely on adaptive and ad-hoc vehicle-based systems and methods. However, in yet other embodiments, for example embodiments designed and configured to resolve vehicle-pedestrian priority conflicts, the methods and systems of the present disclosure may benefit from intersection-based infrastructure.

Several examples of systems and methods for coordinating vehicular traffic flow using a DTCP developed in an ad-hoc vehicle-based network are described below, as are some exemplary apparatuses employing elements that can be used in connection with the exemplary systems and methods. However, as those skilled in the art will appreciate from reading this entire disclosure, the exemplary systems, methods, and apparatus described are but a small selection of those that can be used to accomplish the teachings disclosed herein.

Figure 1:
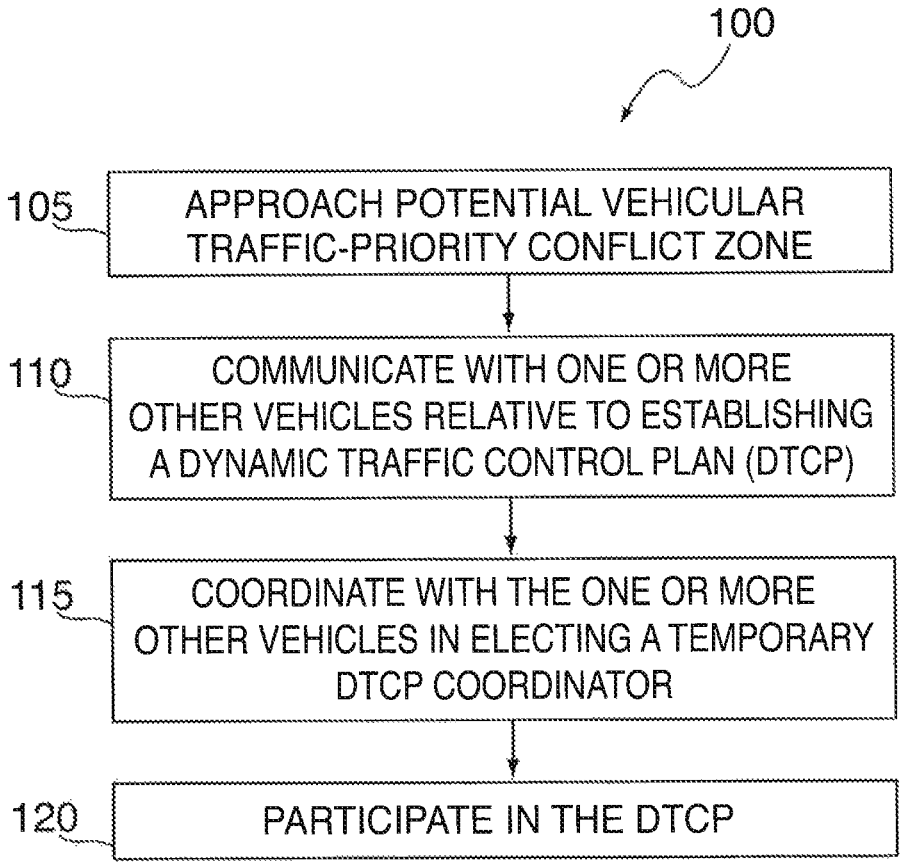
FIG. 1 is a flow diagram illustrating an exemplary method of coordinating vehicular traffic.

Turning now to the drawings, FIG. 1 illustrates an exemplary method 100 of resolving a potential vehicular travel-priority conflict by communicating with approaching vehicles so as to collect data relevant to an incipient conflict, creating a DTCP to avoid or resolve the conflict, and communicating the DTCP to the vehicles participating in the potential conflict. Method 100 can begin by, for example, at step 105 in which at least two vehicles can approach a potential vehicular travel-priority conflict zone. The types of vehicles contemplated in this example, and indeed in the entirety of the present disclosure, can be any propelled, or mobile, vehicle including, for example, a self-propelled, but human-controlled, vehicle having a motor or an engine such as a motorcycle, an automobile, an aircraft, a SEGWAY® personal transporter, an electric cart, a motorized wheelchair, and other similar devices. In other examples, the vehicle can be any self-propelled and self-controlled vehicle, such as an industrial robot, automated equipment, and other types of automated vehicles. In yet further examples, the vehicle can include a human powered vehicle such as a bicycle, a tricycle, a skate-board, and other similar vehicles. Furthermore, method 100 is equally applicable to a potential vehicular travel-priority conflict involving two vehicles of different types. As will be further explained below, the teachings of the present disclosure may even be applied to a pedestrian, which for convenience, is included in the term "vehicle." Fundamentally, there is no limit to the types of vehicles contemplated by the present disclosure, or the types of vehicles that can participate in the conflict-resolving systems and methods described herein.

In addition to the wide variety of vehicles that can approach a potential-travel-priority-conflict zone at step 105 of method 100, the nature of such a zone can be similarly broadly defined. Generally, a "potential-travel-priority-conflict zone" is a zone where two or more movable objects, for example, vehicles, people, etc., and any combination thereof, have the potential of being in conflict with one another in terms of travel priority. Such a conflict typically, but not necessarily, results in a collision or near-collision between movable objects involved. The word "potential" connotes that while an actual conflict can happen, they do not necessarily happen. In other words, while a particular zone has the potential for conflicts, actual conflicts may not happen for a variety of reasons, such as very low traffic volumes and attentive vehicle operators, among others.

In some examples, the potential-travel-priority-conflict zone can include road intersections, such as a traditional road intersection, controlled-access roadway entrance- and exit-ramps, and merging traffic lanes. For reasons that will be explained below, because the methods and systems include utilization of ad-hoc, vehicle-based networks, the potential-conflict zone need not be at a fixed location known prior to the occurrence of a travel-priority conflict, as is presumed with the placement of a traditional traffic light. Instead, the potential-conflict zone can be at any point on a travel route. For example, such travel routes can include, but are not limited to, a one-way street, a two-lane road with anti-parallel lanes, or even a parking lot. Also, in other examples, a potential-conflict zone can occur between a pedestrian and an automobile at an intersection, or at any point not at an intersection. In yet further examples, the potential-conflict zone can occur between aircraft in the air, on a taxi-way, or in some other area. In even further examples, the conflict zone can occur in areas not publicly accessible but still accessible by vehicular traffic, such as pedestrian zones, and warehouses that include both mobile industrial equipment and pedestrian traffic. Fundamentally, there is no limit to the locations at which a potential-conflict zone can be defined because the methods and systems disclosed herein resolve conflicts as they arise, wherever they occur.

Having broadly defined the vehicle types and conflict zones in the context of step 105, at step 110 the vehicles communicate with each other in order to establish a DTCP that utilizes an ad-hoc communication network usable to resolve travel-priority conflicts. In one example, the vehicles communicate with each other using dedicated short-range communications ("DSRC") that can use IEEE 802.11(p) communication protocol. While an example of apparatus used to facilitate DSRC is described in detail below in the context of FIG. 2, it is sufficient for the time being to understand that DSRC employs a DSRC-capable radio to receive and transmit relevant information. These DSRC radios can be included in virtually any type of device, whether included in a vehicle as manufactured, added to a vehicle or vehicle-based dynamic traffic control ("DTC") system using an after-market addition, or included in a mobile communication device (e.g., a cell phone or a smart phone) that is used in conjunction with a vehicle or vehicle-based DTC system. Those skilled in the art, being already familiar with DSRC technology, will appreciate that there is no limit to the manner in which a DSRC radio can be implemented in conjunction with a vehicle in order to enable the teachings of the present disclosure.

Furthermore, as those skilled in the art will appreciate, the DSRC protocol is not the only means by which vehicles can communicate. Other examples of methods by which vehicles can communicate include other radio-frequency communication protocols, cellular communications (including First Generation, Second Generation (2G), Third Generation (3G), Fourth Generation (4G), etc.), Wi-Fi, Wi-Fi enabled internet, laser or other light-based communication or data transfer, and others, as well as combinations thereof.

Continuing with step 110, a variety of inputs can be used to identify anticipated priority conflicts and establish the DTCP that is subsequently communicated to the other vehicles approaching the travel-priority conflict zone. For example, one type of input includes vehicle-specific metrics. The metrics include, but are not limited to, velocity of travel, distance from the conflict zone, vehicle weight, indicia of traffic congestion, and direction of travel. Other types of inputs can include travel-route features stored in a travel-route database. Examples of these types of inputs can include, but are not limited to, lane-width, road-width, changes in lane- or road-direction or elevation, obstructions to vehicle travel or visibility, construction projects affecting vehicle flow, and many other similar characteristics that can be appreciated by those skilled in the art.

Yet further examples of inputs that can be used to identify anticipated priority conflicts include indirectly acquired factors that can be based on calculations using the above mentioned direct inputs. One example illustrating this concept is the calculation of the stopping distance of a vehicle based on the direct inputs of vehicle velocity, weight, and travel-route surface conditions e.g., surface type (gravel, concrete, asphalt, etc), and surface quality (e.g., dry, wet, snow-covered, ice-covered, etc.). These indirectly acquired factors can then be compared to the directly acquired vehicle position to determine if the vehicle can stop safely before entering the conflict zone.

Other indirectly acquired factors can also include parametric factors that are based on directly acquired inputs and indirectly acquired factors, which are then analyzed using statistical and mathematical methods well known to those skilled in the art. For example, continuing with the immediately preceding example of stopping distance, a processor in communication with a system can determine whether a vehicle can stop safely before entering a conflict zone based on direct inputs of vehicle velocity and weight that are then used in connection with a statistical analysis algorithm that determines the probability of the vehicle stopping safely. Using this type of parametric analysis can further enhance the sophistication, precision, and accuracy of this aspect of the system. Furthermore, priority conflicts can be anticipated using a process known as beaconing in connection with a location database. The application of these two elements will be discussed in more detail in the context of FIG. 2.

The foregoing examples are, of course, not necessary in the event that a vehicle approaches a conflict zone for which there is already an active DTCP. In this case, the approaching vehicle need only receive the existing DTCP through any of the communication methods described above and execute the instructions therein, if any. In some circumstances, a vehicle can receive an active DTCP and facilitate its transmission to the other vehicles. This receiving vehicle, known as a "traffic coordinator," is described below in the context of creating a new DTCP. It will be appreciated that, while in many situations the DTCP can be created upon approaching a potential travel-priority-conflict zone, as described immediately above, in some cases an existing DTCP is merely transferred to a new vehicle to maintain execution of an existing DTCP.

At step 115 of method 100, vehicles approaching a potential travel-priority-conflict zone communicate with each other, using the methods and systems described above, to elect a vehicle that can provide a coordinated set of DTCP instructions to vehicles participating in the ad-hoc vehicle-based network established to avoid any real conflicts that could occur in the potential travel-priority conflict. This elected vehicle, for the purposes of the present disclosure, is known as a traffic coordinator.

The traffic coordinator can be elected from among candidates in the ad-hoc vehicle-based network based on any one or more of a number of different factors, including those factors that indicate the ability to stop safely before a conflict zone, the ability to influence the traffic flow through the conflict zone, the traffic density on the various approaches to the travel-priority conflict zone, and others. For example, a subset of candidates for coordinators may be identified as those leading their respective queue of vehicles on a given approach to a priority-conflict zone (illustrated by FIG. 6, which is described below in detail). In this example, these vehicles will be the first to arrive at the conflict zone, and are therefore more likely to be in communicative contact with vehicles approaching the conflict zone from other directions. This arrangement facilitates, but is not required for, V2V communication. Furthermore, those vehicles leading their respective queues can prevent the vehicles trailing them from proceeding further, thereby controlling the vehicular traffic flow if so required by the DTCP. Other factors that can be used to elect the coordinator include, for example, the ability to stop safely before entering the potential travel-priority-conflict zone, the presence of possible barriers to V2V communication, possible priority status of vehicles approaching the potential conflict zone (e.g., emergency-service vehicles), traffic planning policies favoring higher traffic flow in a given direction, and road features (e.g., blind spots, road curvature, local road topography, vehicle density generally and on specific approaches to the conflict zone, etc). Those skilled in the art will appreciate that other factors can also be used to elect a traffic coordinator.

Once elected at step 115, the traffic coordinator can broadcast its election as the traffic coordinator, thereby informing proximate vehicles of its identity and location. Also, once elected, the coordinator can establish a DTCP, as described above, and communicate it to the other vehicles approaching the potential-travel-priority-conflict zone. Optionally, the coordinator can periodically re-broadcast its identity as traffic coordinator and re-broadcast the DTCP to confirm control of the potential-conflict zone and inform any newly arrived vehicles.

While the examples of the present disclosure are primarily directed to localized travel-priority-conflict zones, various teachings found herein can also be applied to ad-hoc vehicle-based networks over a larger geographic area in order to facilitate travel efficiencies on a larger scale. In one embodiment, using techniques described below to facilitate longer-range communication (e.g., Geocasting, as explained below), traffic coordinators at remote potential-conflict zones can communicate. This communication can facilitate regional traffic-flow efficiency by, for example, providing DTCP instructions to clear travel zones of vehicles in preparation for an approaching emergency-service vehicle or, in another example, to coordinate the traffic flow through multiple conflict zones to increase the "green-light split" (i.e., the percentage of time vehicles on a given approach are permitted to proceed through the zone) along a desired travel-route, thereby reacting to variations in traffic density. For example, the green-light split can be calculated, and implemented, by the system according to the following formula:

$$GT_i = \frac{ncars_i}{N} * \min\{T_{max}, (T_{min} + N * w)\}$$

wherein, $GT_i$ is the green-light split for an i-th travel-route, $ncars_i$ is the number of vehicles on the i-th travel-route, N is the total number of vehicles at the priority conflict zone, $T_{max}$, $T_{min}$ are the maximum and minimum time durations allowed for a complete priority cycle, respectively, and w is a weighting factor that increases the minimum time as a function of the number of vehicles at the conflict zone. Under conditions in which the travel-route is saturated with vehicles, the complete cycle always has a duration of $T_{max}$. However, under conditions in which the traffic density is low, the cycle duration is near $T_{min}$, allowing fast switching between the approaches to the conflict zone. Furthermore, in yet another embodiment, the ad-hoc system can be informed of local traffic planning policies through a program (described in the context of FIG. 2) that can affect traffic flow, thereby taking advantage of larger-scale traffic management.

Continuing with method 100, at step 120, the traffic coordinator having been elected and the DTCP having been created and communicated to vehicles approaching a potential-travel-priority-conflict zone in the above-described steps, the vehicles can then participate in the DTCP. In one example, DTCP instructions are communicated to the vehicles participating in the ad-hoc vehicle-based network corresponding to the potential-travel-priority-conflict zone by providing each vehicle with a virtual traffic control, such as an in-vehicle traffic light. As used herein and in the appended claims, the term "virtual" when used in the context of a traffic control, traffic control signal, or other traffic control means, refers to any such means that is effectively a replacement for one or more traditional infrastructure-based traffic control means, such as traffic lights, traffic signals, traffic signs, etc. as well as a human or automated traffic director that would traditionally be located at a potential travel-priority-conflict zone.

In one example, depending on the instruction(s) sent to the vehicle(s) by the coordinator, a red, amber, or green light is presented to the operator of a vehicle participating in the conflict. Additionally, other types of virtual traffic control can be used to communicate the DTCP instructions to vehicles participating in an ad-hoc vehicle-based network for a particular potential-travel-priority-conflict zone. For example, the instructions can be provided aurally to the vehicle operator through a vehicle radio, a global-positioning system (GPS) device, a portable communications device (e.g., a mobile phone), or other similarly enabled system. In other examples, in which the DTCP instructions are provided directly to a vehicular control system, the vehicle itself will be able to respond directly to the instructions from the traffic coordinator. Those skilled in the art will appreciate that there are many techniques for executing the DTCP plan such that the vehicles and/or their operators participate in the plan. Particular examples of various means that can be used to display these in-vehicle virtual traffic controls are presented in further detail below within the context of FIGS. 3 and 4.

Figure 2:
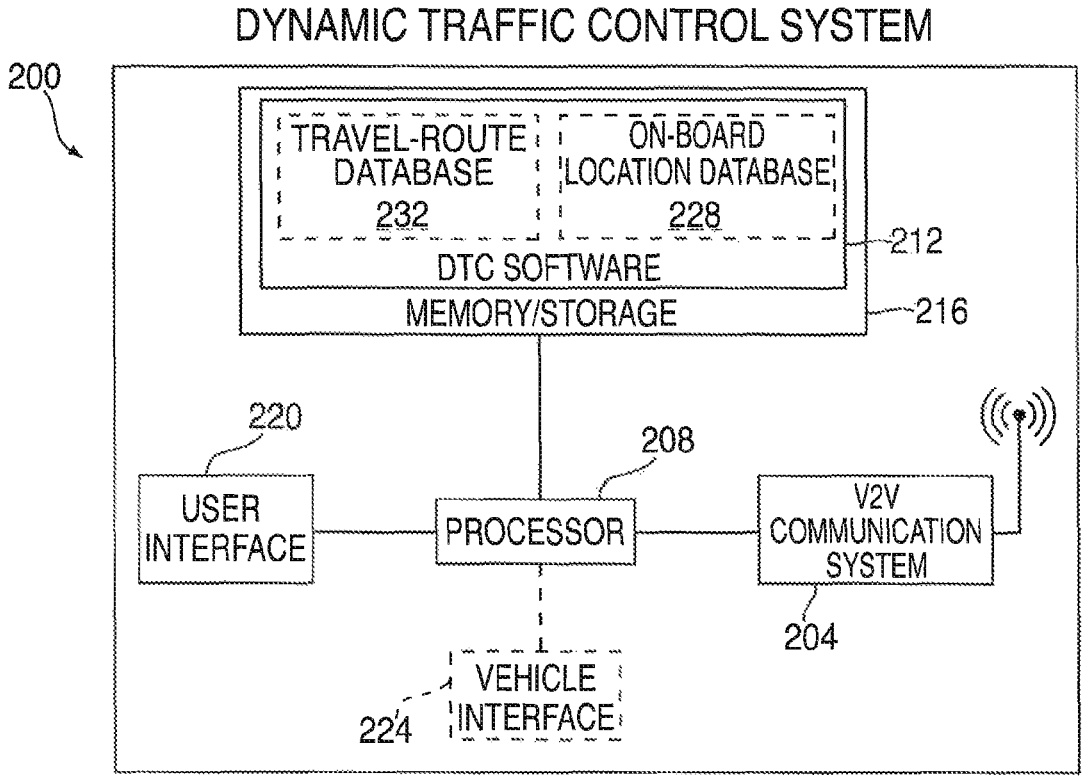
FIG. 2 is a high-level block diagram of a dynamic traffic control system.

Referring now to FIG. 2, system 200 illustrates a DTC system used to implement, for example, method 100 described in the context of FIG. 1. System 200 includes, for example, a (V2V) communications system 204, a processor 208, DTC software 212, a physical memory 216, a user interface 220, and an optional vehicle interface 224. These elements can be used together, in whole or in part, to create a DTCP, communicate a DTCP to other vehicles, receive a DTCP from another vehicle, and execute the instructions supplied by the DTCP, depending on the configuration of DTC system 200 and the needs of the particular DTCP ad-hoc vehicle-based network under consideration. DTC system 200 can also optionally include an on-board location database 228 and/or a travel-route database 232.

In one embodiment of system 200, V2V communications system 204 is designed and configured to receive signals from at least one other vehicle within the ad-hoc vehicle-based network at issue that have the same or similar V2V communications system. As described above in the context of FIG. 1, these signals can include information characterizing the type of vehicle, its weight, its speed, relevant traffic and road conditions, and the manner of approach of a vehicle, among many others. V2V communications system 204 is also designed and configured to provide a communications link between vehicles approaching a potential travel-priority conflict zone, as described above in the context of FIG. 1, in order to elect a traffic coordinator, collect data, and perform analyses so as to create a DTCP, as well as to communicate the DTCP to the participating vehicles.

V2V communications system 204 is designed and configured to transmit and receive signals communicating DTCP instructions using any one or more of a variety of protocols. For example, V2V communications system 204 may broadcast signals transmitting DTCP instructions periodically from a vehicle through a process known in the art as "beaconing." As part of the beaconing process, the information described above is communicated at regular intervals and throughout a given geographic area surrounding the vehicle performing the beaconing. These beaconing signals can be received and/or retransmitted by another DTC system similar to system 200 through V2V system 204. Furthermore, beaconing signals can be used in cooperation with on-board location database 228. The use of this location database 228 with the periodically repeated beaconing signals can permit DTC system 200 to track the location of proximate vehicles. Even further, when location database 228 and beaconing signals are used with travel-route database 232, DTC system 200 can anticipate travel-priority conflict zones because the system is informed of, at the minimum, the location and velocity of proximate vehicle in the context of known travel-routes. In some examples, this can permit DTC system 200 to adapt to local vehicle densities and to anticipate, and accommodate, density trends.

V2V communications system 204 may also or, alternatively, be designed and configured to transmit and receive signals using non-beaconing protocols as well, such as signals transmitted to or from another proximate vehicle directly, for example using a handshake, push, or pull protocol, among others. Or, in yet another example, the above-described signals can be communicated between vehicles using a method known in the art as "Geocasting." In this method, vehicles can communicate with other vehicles regionally proximate but out of DSRC range by using intervening vehicles as transponders that propagate the DSRC signal. Those skilled in the art will appreciate that beaconing, Geocasting, and direct transmission are but a selection of the many existing techniques that can be used in connection with the teachings of the present disclosure.

Processor 208 is designed and configured to receive one or more signal(s) from V2V system 204 and initiate an analysis of the information contained in the signal(s) as a precursor to developing a DTCP. Processor 208, which can include multiple processors operating together, is linked by connections that enable operative communication between V2V communications system 204, physical memory 216, user interface 220, and vehicle interface 224. These communication means can include physical connections, such as metal conductors, Ethernet cable, optical fiber, and others well known in the art. Additionally, non-physical connections, such as wireless communication over radio frequencies (e.g., BLUETOOTH® radio, WiFi, etc.), mobile communication device frequencies, or optically using visible or non-visible light. Those skilled in the art will appreciate that many other communications methods are also possible without departing from the teachings of the present disclosure. Furthermore, although it can be, processor 208 need not be specifically dedicated to DTC system 200. Indeed, devices that can be used to supply processor 208 are ubiquitous throughout modern society. These devices include pre-existing processors in vehicles (often referred to as electronic control units, engine control units, or "ECUs"), mobile phones, and many other devices that can be programmed to be used in conjunction with a vehicle or by an operator of a vehicle.

Processor 208 employs DTC software 212 to analyze inputs relevant to anticipated particular potential-travel-priority-conflict zone, as described above in connection to FIG. 1. DTC software 212, stored in physical memory 216 and in operative communication with processor 208, can execute any of a wide variety of analytical operations upon inputs in furtherance of developing a DTCP. Examples of these analytical operations have been described previously in the context of FIG. 1 and need no further explanation for those skilled in the art to understand them. Furthermore, as also described previously, DTC software 212 can include on-board location database 228 and/or travel-route database 232 and/or lane-level data, either or both of which can include information relevant to the creation of a DTCP by DTC system 200, and which can be updated periodically.

It should be understood that while on-board location database 228 and travel-route database 232 are mentioned above specifically, other databases (not shown) can be used to contribute to the analysis of the anticipated travel-priority conflict depending on the specific application of DTC system 200. Exemplary applications of DTC system 200 include creating DTCPs to avoid pedestrian-pedestrian conflicts, and pedestrian-motorized vehicle conflicts, in zones that can have unrestricted access (e.g., a public road intersection) or in zones that have restricted access (e.g., pedestrian zone, bike path, parking lot, etc.). For example, these databases can include a building floor plan, a manufacturing-facility or warehouse layout, a map of a city that also includes pedestrian walkways and bike paths (defining vehicle-free zones), and air-routes specified by altitude and geospatial coordinates. Those skilled in the art will appreciate that many other examples of databases can be used in connection with DTC software 212 to enhance the development of a DTCP for a variety of applications.

As mentioned above, physical memory 216 stores DTC software 212 and any necessary desired database, such as on-board location database 228, and travel-route database 232, and/or other information, and is in operative communication with processor 208. As is well known in the art, physical memory 216 can include, for example, flash memory, magnetic memory, optical memory, and other types known in the art, and any combination thereof, excluding transitory signals. Those skilled in the art will appreciate the wide variety of techniques that can be used to store DTC software 212 and other information in physical memory.

User interface 220 is in operative communication with processor 208 and can be designed and configured, for example, to communicate traffic control instructions to an operator of a vehicle needed to comply with a DTCP, thereby obviating an anticipated travel-priority conflict. In some examples, user interface 220 is a display capable of displaying red, amber, and green lights in response to an appropriate DTC signal, thereby providing traffic control instructions to the operator of a vehicle that are analogous to instructions provided by a conventional infrastructure-based traffic light, and therefore familiar to vehicle operators. As mentioned above, instructions can also be provided by user interface 220 of a mobile communications device, a GPS unit, and can be symbolic (e.g., the in-vehicle traffic light), spoken (e.g., through the speaker unit of a mobile communications device, GPS unit, or in-vehicle sound system), graphically displayed (e.g., a dedicated in-vehicle display, a generic in-vehicle display, a heads-up display or projection, or a mobile communications device), or otherwise communicated. Those skilled in the art will appreciate the many types of devices that can function as user interface 220, in addition to those mentioned above. User interface 220 can also be used by DTC system 200 to solicit input from an operator (or occupant) of the vehicle, such as preferences and settings for the system or to provide additional information in order to inform processor 208 of information relevant to the DTCP. The types of relevant information are described elsewhere in this disclosure, and are also apparent to those skilled in the art.

Furthermore, as those skilled in the art will appreciate, DTC system 200 can also be used to implement other methods, in addition to method 100, consistent with the teaching of the present disclosure. For example, while the foregoing discussion presents the receipt of signals from other vehicles, DTC system 200 can function equally well in the transmission of signals to other vehicles, as described in the context of FIG. 1. In one example, upon receiving data from other vehicles used to create a DTCP, DTC system 200 can transmit the DTCP to the other vehicles using the system.

DTC system 200 may optionally include a vehicle interface 224 that can interact directly with the operative functionality of the vehicle, thereby automatically implementing the DTCP without the cooperation of the vehicle operator. For example, upon receipt or creation of a DTCP, vehicle interface 224 may, through operative connections to the various vehicle systems (e.g., propulsion, steering, braking, directional signal, etc.) direct the vehicle to conform to the DTCP. For example, if the DTCP requires the vehicle to stop at a given coordinate for at least 30 seconds or until otherwise approved to proceed, vehicle interface 224 can interact with propulsion and braking systems of the vehicle in order to conform to the instructions. This operative connection can be enabled through autonomous driving technology as illustrated, for example, in U.S. Patent Application Publication No. 2008/0243388 to Eguchi et al. While the teachings of the present disclosure can be used in concert with this and other related technologies, to automatically conform the vehicle's conduct to the DTCP, those skilled in the art will appreciate that other methods of placing vehicle interface 224 in communication with relevant vehicular systems are available.

Vehicle interface 224 can also provide vehicle data and information in order to better inform system 200 in the creation of the DTCP. For example, vehicle interface 224 can provide velocity, heading, vehicle type, acceleration (using an in-vehicle accelerometer), vehicle priority status, and other information relevant to the creation of the DTCP to processor 208. This information can then be used by processor 208 in cooperation with DTC software 212 to create a DTCP. Of course, as mentioned elsewhere in this disclosure, this information may also be communicated via V2V communications system 204 to another vehicle that has been elected as a traffic coordinator and charged with creating the DTCP.

Figure 3:
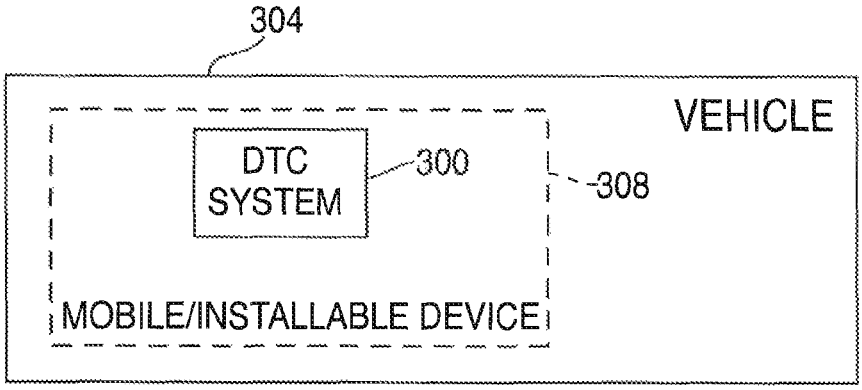
FIG. 3 is a high-level block diagram illustrating an exemplary embodiment of a dynamic traffic control system using a mobile communication device in connection with a vehicle to participate in the dynamic traffic control plan.

FIG. 3 illustrates an exemplary instantiation, in which a DTC system 300 is located on-board a vehicle 304, such as an automobile, truck, bus, train, aircraft, etc. As described above, DTC system 300 can be integrated into vehicle 304 in any of a variety of ways, such as being installed as an after-market device or as an original equipment system. As those skilled in the art will readily be able to envision, when DTC system 300 contains some or all of the components of DTC system 200 of FIG. 2, those components can be contained largely or entirely within a single installed device or may alternatively be spread out throughout vehicle 304. Alternatively, DTC system 300 of FIG. 3 can optionally be integrated into a mobile device 308 that can be placed on-board vehicle 304, for example, by the operator (not shown) of the vehicle. Examples of mobile devices that can be used for mobile device 308 include a smart phone, GPS unit, a personal multimedia device, a personal gaming device, and a tablet personal computer, among many other similar devices known to those skilled in the art. Details and examples pertinent to DTC system 300, mobile device 308, and vehicle 304, as well as the means, methods, and mechanisms by which they communicate and interact, are above or are well known in the art, and need not be explained further for those skilled in the art to be able to execute the features and aspects disclosed in FIG. 3.

Figure 4:
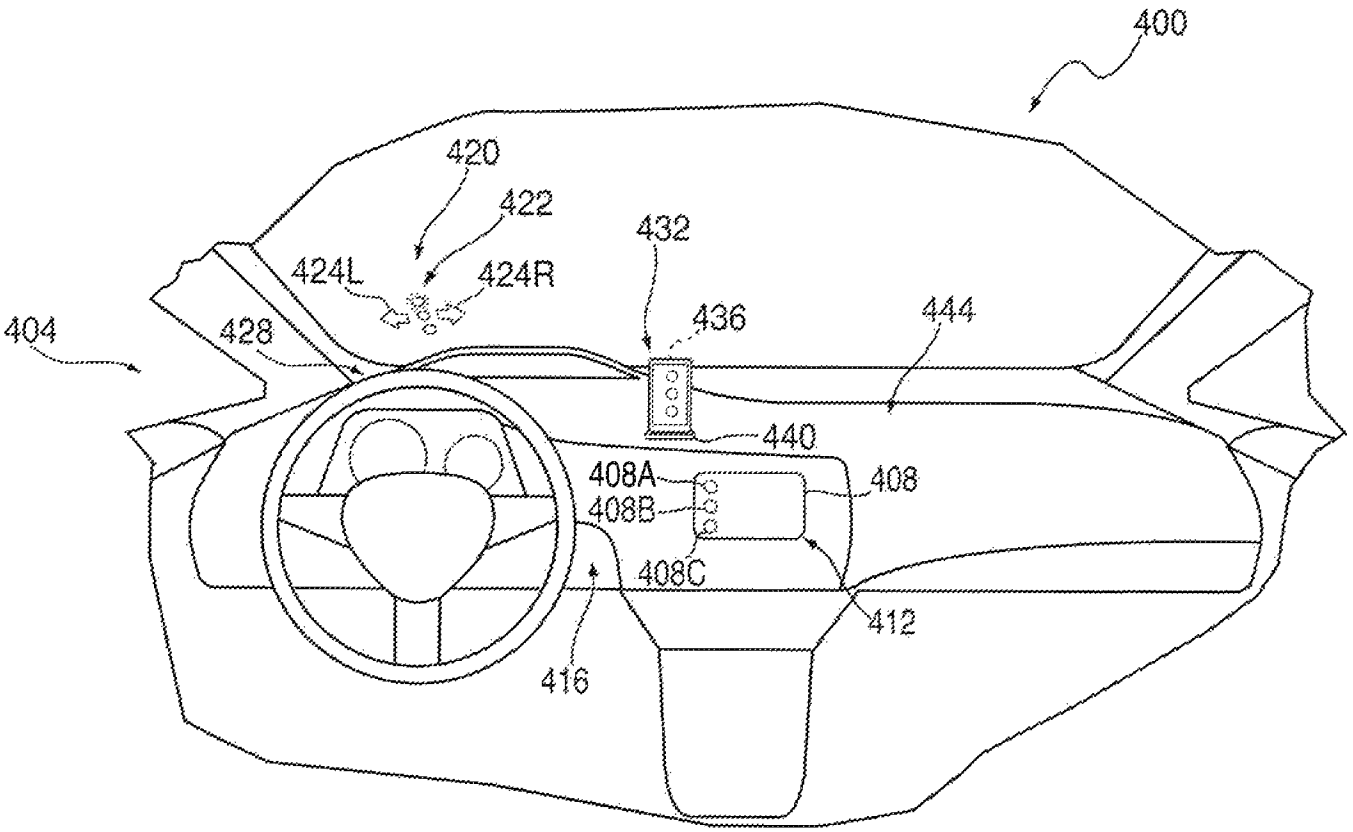
FIG. 4 is an elevational view of the dashboard region of a vehicle illustrating various ways of implementing a virtual traffic signal.

FIG. 4 shows a dashboard region 400 of an automobile 404 containing a DTC system (not shown) of the present disclosure. Examples of DTC systems that can be implemented in automobile 404 include, but are not limited to, DTC systems 200 and 300 of FIGS. 2 and 3, respectively, each of which can be configured to execute method 100 of FIG. 1 or similar DCT method. FIG. 4 is provided to particularly illustrate various ways of instantiating a particular type of virtual traffic control, specifically a virtual traffic signal that mimics a traditional infrastructure-type three-light traffic signal configured to implement conventional green, amber, and red phases of the control cycles. In one instantiation, a three-light virtual traffic signal 408 is displayed on a display 412 built into the dashboard 416 of automobile 404. Display 412 can be, for example, an existing touchscreen-type display for displaying, and/or allowing users to interact with, other features of automobile, such as a sound system, climate-control system, backup-camera system and/or GPS, among others. In the example shown, virtual traffic signal 408 has three light positions 408A to 408C, for correspondingly displaying a red light, an amber light, and a green light in accordance with the U.S. standard arrangement of colors/phases. Even more particularly, FIG. 4 illustrates red light, i.e., position 408A, as being illuminated, indicating that the DTC system is instructing display 412 to instruct the vehicle operator that automobile 404 is subject to the red phase of the traffic control cycle, meaning that the automobile should either come to a stop or remain stopped, depending on the state of the automobile at the time of illumination of red phase. When position 408A is illuminated, positions 408B and 408C are not illuminated, signifying that the corresponding signal phases are not active.

Automobile 404 may additionally or alternatively be outfitted with a heads-up display (HUD) 420 that display another three-light virtual traffic signal 422 that can be the same as virtual traffic signal 408 displayed on built-in display 412. As those skilled in the art will readily appreciate, the vehicle operator may have the ability to turn on and off HUD 420 as desired. If automobile 404 includes both virtual traffic signals 408, 422, turning on HUD 420 may turn off traffic signal 408, or not. In this example, HUD 420 also includes directional signals 424L and 424R, which can be controlled by the DTC system aboard automobile 404, as described above in connection with vehicle interface 224 of DTC system 200 of FIG. 2. Although not shown, those skilled in the art will understand that another possible location for a virtual traffic signal is in the instrument panel region 428.

As an alternative to built-in display 412 and HUD 416, a virtual traffic signal 432 can be displayed on a mobile device 436, which in this example, is docked in a corresponding dock 440, which may be an aftermarket feature or an original equipment feature secured to or otherwise connected to the dashboard cover 444 of automobile 404. Mobile device 436 can be any suitable device that a user can readily remove from dock 440 and carry away from automobile 404, such as a smart phone, personal multi-media device (e.g., an iPod® device available from Apple, Inc., Cupertino, Calif.), personal gaming device, tablet computer, GPS unit, etc. In one embodiment, mobile device 436 is in operative communication with the DTC system aboard automobile 404 either wirelessly (e.g., via a BLUETOOTH® radio) or wiredly (e.g., via dock 440 having a suitable connector). In another embodiment, mobile device 436 itself contains the DTC system, for example in the manner of mobile device 308 of FIG. 3. In that embodiment, automobile 404 need not have any components of a DTC system. As also explained above, other methods of communicating the DTCP instructions to the operator or directly to the vehicle are possible.

Figures 5, 5A:
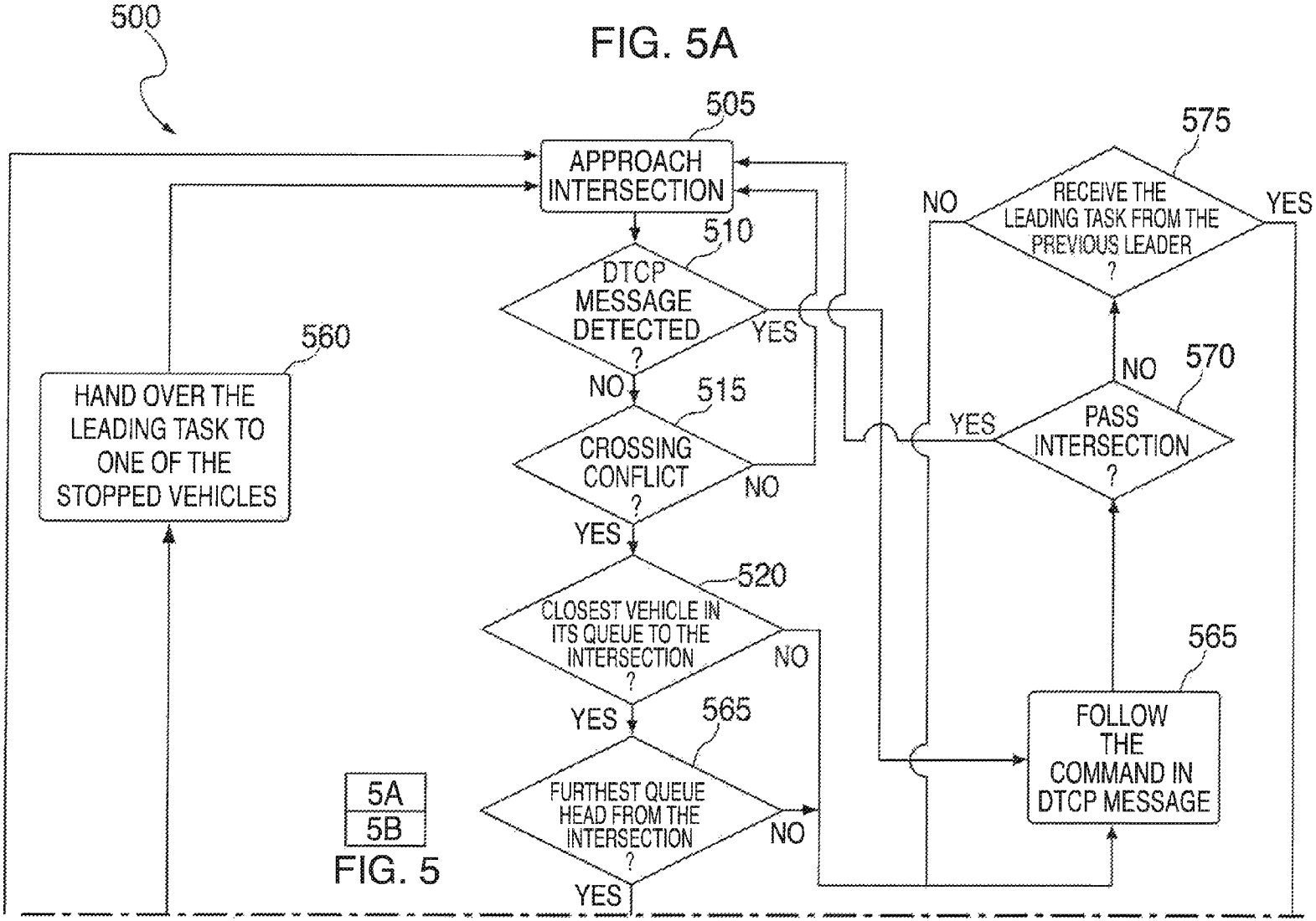
FIGS. 5A and 5B are a flow diagram illustrating an exemplary method of resolving a potential vehicle travel-priority-conflict.
Figure 5B:
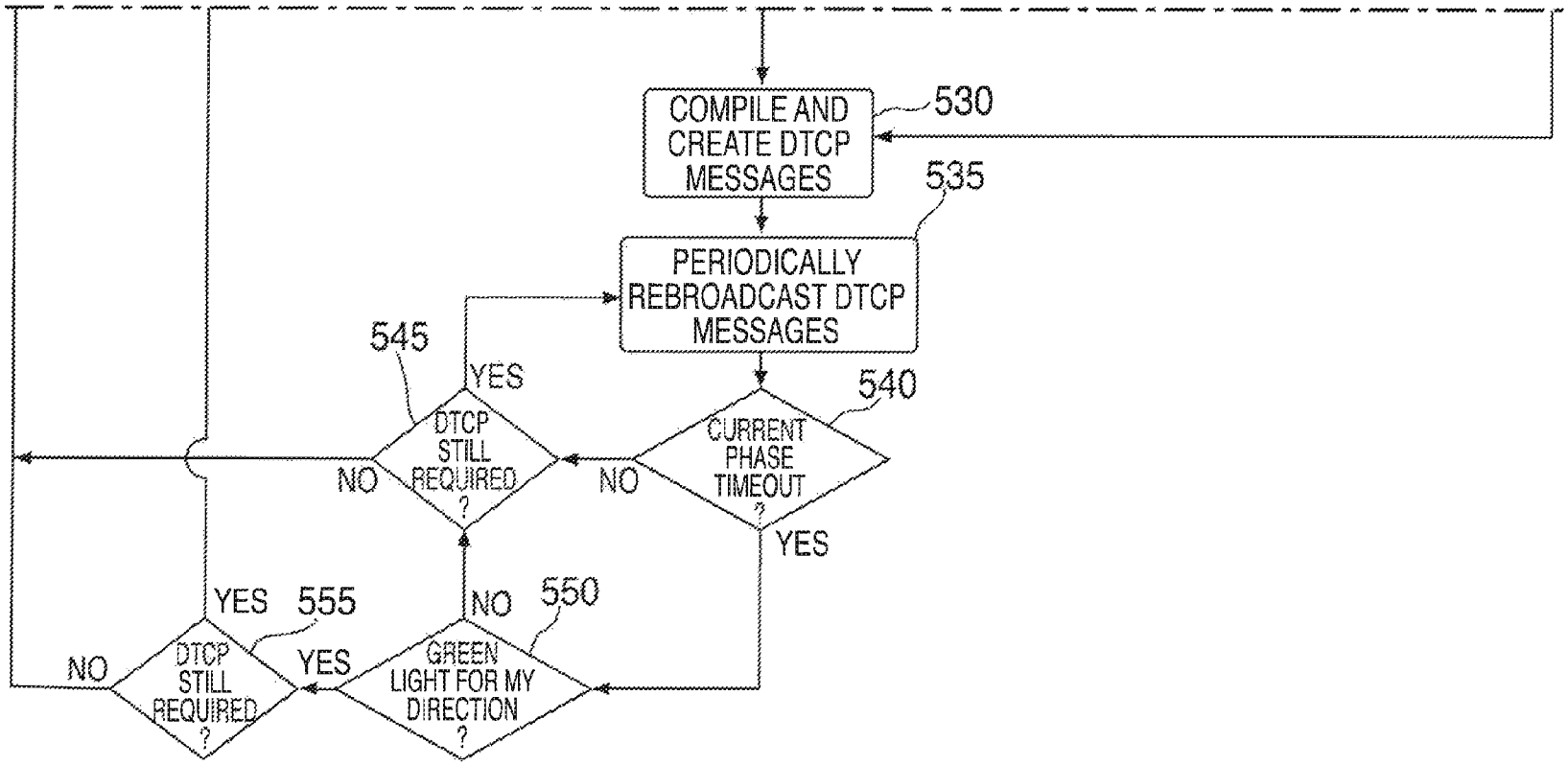

As presented above, traffic flows can be regulated using, for example, method 100 of FIG. 1. As a particular example, FIG. 5 illustrates a method 500 that is a particular embodiment of method 100 and that can resolve potential travel-priority conflicts at a particular potential-travel-priority-conflict zone 600, as depicted in FIGS. 6A-6D. As will become apparent from reading on, the steps of method 500 need not necessarily be performed in the order shown to achieve an equivalent result.

Figure 6A:
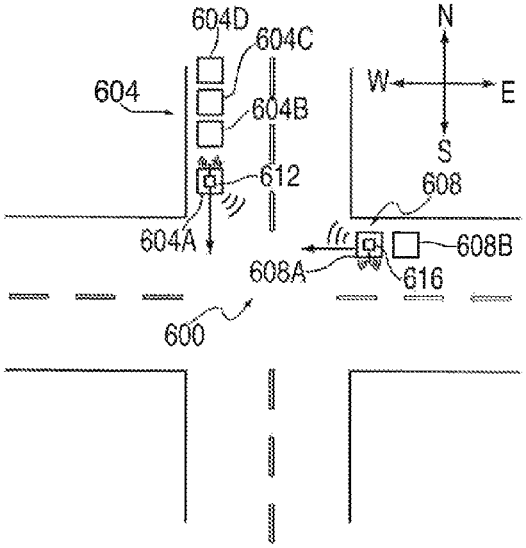
FIGS. 6A-6D are schematic diagrams of an intersection illustrating step-by-step resolution of a potential vehicular travel-priority conflict using the method of FIG. 5.

Referring now to FIGS. 6A-6D, and also to FIG. 5, method 500 of FIG. 5 begins at step 505 in which a plurality of vehicles 604A to 604D, 608A, and 608B approach potential-travel-priority-conflict zone 600. As shown in FIG. 6A and as mentioned above, potential-conflict zone 600 is depicted to provide a context in which method 500 can be discussed. In this example, potential-conflict zone 600 is a traditional 4-way intersection that would, in conventional circumstances, be regulated using intersection-based infrastructural traffic signs or signals. As is also depicted in FIG. 6A, a queue 604 of four vehicles 604A to 604D, traveling south, is approaching potential-conflict zone 600. The potential conflict, and therefore potential-conflict zone 600, is precipitated by another approaching queue 608 of two vehicles 608A and 608B, traveling west.

A DTC system 612 is located aboard lead vehicle 604A of queue 604 and is in communication with a DTC system 616 located aboard lead vehicle 608A of queue 608 to form part of an ad-hoc vehicle-based DTC network surrounding potential-conflict zone 600. In this example, the two lead vehicles 604A and 608A are geographically closest to the conflict zone. As explained above, this arrangement facilitates the communication of information relevant to resolving any potential travel-priority conflict and to electing a traffic coordinator, as described above.

At step 510, DTC systems 612 and 616 of lead vehicles 604A and 608A, respectively, each determine whether it is receiving instructions of an existing DTCP. Assuming, for this example, that no pre-existing DTCP instructions are being received, at step 515 (FIG. 6A) DTCP systems 612 and 616 next determine, using techniques and methods described above, whether a potential travel-priority conflict exists in potential-conflict zone 600. If DTC systems 612 and 616 determine that there is no potential travel-priority conflict, each vehicle would be free to proceed through potential-conflict zone 600 and to repeat the above steps at the next potential-travel-priority-conflict zone it encounters. However, as is evident from the description above and as implied in FIG. 6A, if at step 515 DTC systems 612 and 616 determine that there is a potential travel-priority conflict, method 500 proceeds to step 520.

Figure 6B:
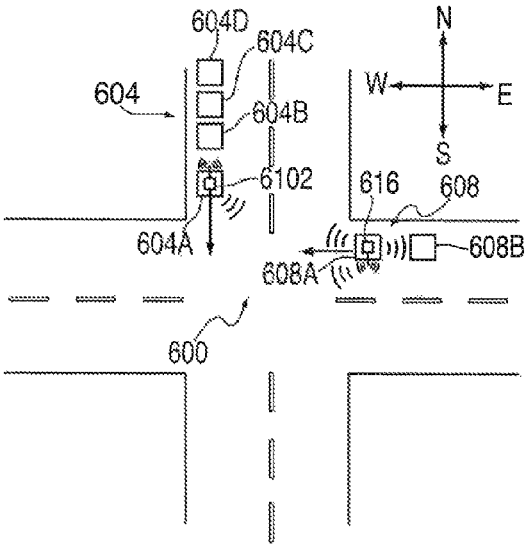

At step 520, each of DTC systems 612 and 616 begins a two sub-step election process for electing a traffic coordinator, as described above. At the first sub-step, that is step 520, DTC systems 612 and 616 find candidate vehicles by determining which vehicles lead their particular queues, here queues 604 and 608, of vehicles, here vehicles 604A to 604D, 608A, and 608B. Upon completing step 520, DTC systems 612 and 616 proceed to the second sub-step in the traffic coordinator election process, that is, step 525. At step 525, DTC systems 612 and 616 elect a traffic coordinator based on a number of factors discussed above, including determining which one of all of the vehicles 604A to 604D, 608A, and 608B is the closest to the intersection. Following these two steps, and as shown in FIG. 6B, DTC systems 612, 616 collaborate to elect vehicle 608A as the traffic coordinator. DTC system 616 of vehicle 608A then computes and periodically rebroadcasts a DTCP to all other proximate vehicles at steps 530 and 535. In this example, such proximate vehicles are vehicles 604A to 604D and 608B. Under the DTCP illustrated, as shown in FIG. 6C, vehicles 604A to 604D in queue 604 are instructed to proceed through potential-conflict zone 600, while vehicles 608A and 608B in queue 608 are instructed to be stopped as vehicles 604A to 604D proceed through the potential-conflict zone.

Figure 6C:
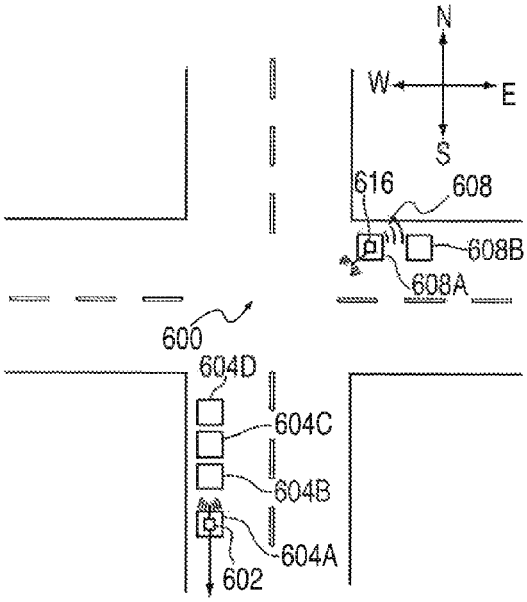
Figure 6D:
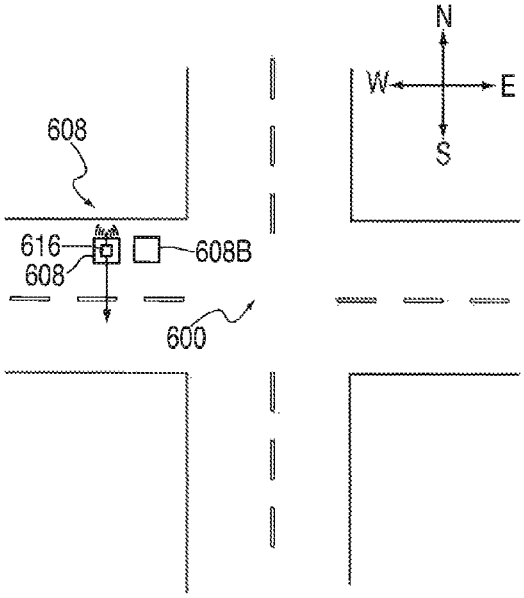

At step 540, with reference to FIG. 6C, after broadcasting the DTCP for a pre-determined period of time, a system-timeout routine within DTC system 616 (currently, the elected traffic coordinator) is triggered as a precursor to transitioning traffic coordination to the DTC system of another vehicle. If the pre-determined time period has not expired and a DTCP is still required, as shown at step 545, then DTC system 616 aboard vehicle 608A, depicted in FIGS. 6B and 6C, remains the traffic coordinator, and that DTC system returns to step 535 in order to rebroadcast the DTCP. If, however, at step 545 DTC system 616 determines that no DTCP is required, it ceases its traffic coordination function, and permits vehicles 608A and 608B of queue 608, to proceed through potential-conflict zone as illustrated in FIG. 6D and continue on their routes until method 500 repeats at step 505.

Alternatively to the immediately preceding routine, if at step 540 the pre-determined time period for the DTCP has expired, then DTC system 616 (again, currently the traffic coordinator) proceeds to step 550. At step 550, DTC system 616 determines whether the DTCP instructions permit vehicles 608A and 608B of queue 608 to proceed through potential-conflict zone 600. If DTC system 616 does not permit vehicle 608A to travel through potential-conflict zone 600, then steps 545 and 550 are repeated.

If at preceding step 550 vehicle 608A is permitted to proceed through potential-conflict zone 600, then DTC system 616 proceeds to step 555, at which the system determines whether a DTCP is still needed to facilitate resolution of a potential travel-priority conflict. If no DTCP is required at step 555, vehicles 608A and 608B of queue 608 proceed until the next potential travel-priority conflict is anticipated at potential-conflict zone 600 by another ad-hoc vehicle-based network, thereby restarting the process at step 505. If a DTCP is still required at step 555, at step 560 DTC system 616 identifies another vehicle participating in the travel-priority conflict, and transfers the DTCP, and traffic coordination duties, to that vehicle. Now, as depicted in FIG. 6D, former traffic coordinator, vehicle 608A, proceeds until restarting the process at step 505.

The foregoing steps assume that, at step 510, no existing DTCP is being executed for potential-conflict zone 600 before method 500 proceeded to step 515. However, if a DTC system, for example DTC system 612, determines at step 510 that a preexisting DTCP is resolving potential travel-priority conflicts at potential-conflict zone 600, then the system proceeds to step 565, at which the preexisting DTCP is followed by DTC systems 612 and 616 in queues 604 and 608, respectively. At step 570 the preexisting traffic coordinating DTC system determines which one of queues 604 or 608 will be permitted to pass through travel-priority-conflict zone 600 first. Assuming that, as shown in FIG. 6C, the DTC system permits queue 604 to pass through conflict zone 600 at step 570, the queue can proceed until restarting the process at step 505 at a different travel-priority conflict zone. However, if at step 570 queue 604 is not permitted to proceed through the zone, DTC system 612 may either assume the traffic coordination role, or not, at step 575. If, at step 575, DTC system 612 does not assume the traffic coordination role, then the system returns to step 565. If, at step 575, DTC system 612 does assume the traffic coordination role, then the system proceeds to step 530, and its subsequent steps and decision points, as described above.

Figure 7:
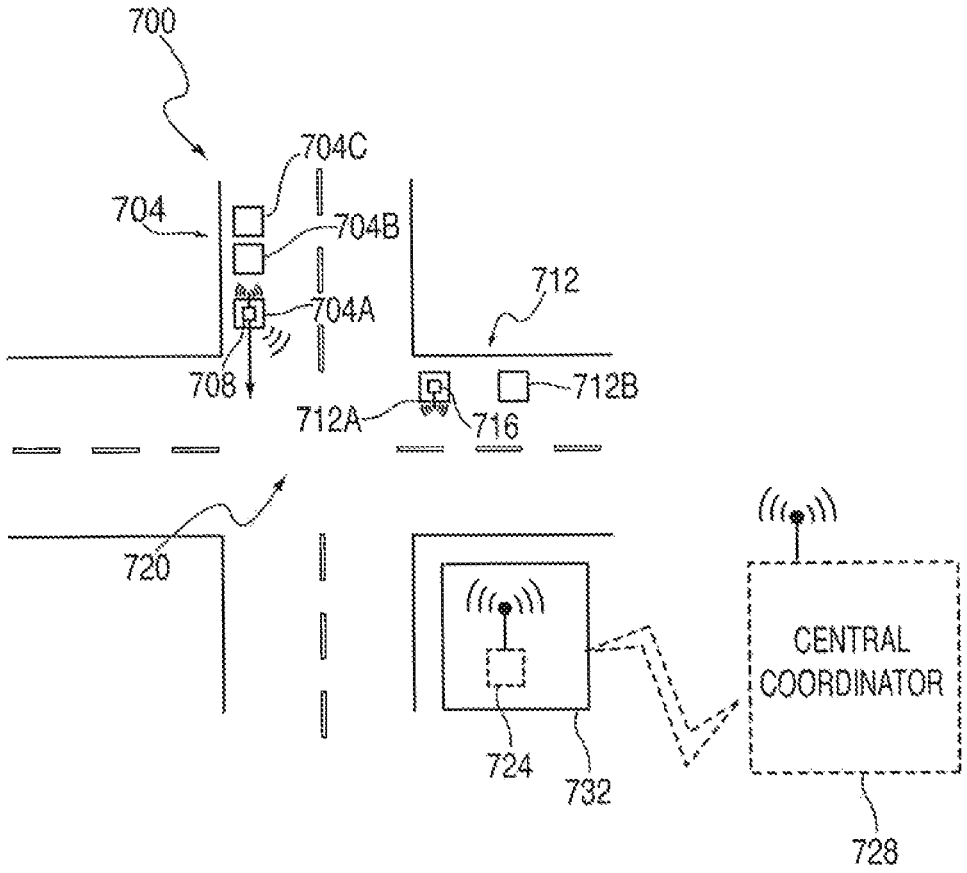
FIG. 7 is a schematic diagram of an intersection illustrating a dedicated traffic control system that includes a central coordinator.

While the preceding examples describe scenarios involving only direct vehicle-to-vehicle communication, other examples can also include communication with a central planner, thereby enabling avoidance of travel-priority conflicts over a geographic area and optimization of traffic flow. In some examples, this can be applied to Smart City applications. In FIG. 7, scenario 700 illustrates a first queue 704 of vehicles, here including vehicles 704A, 704B, 704C and a DTC system 708, a second queue 712 of vehicles, here including vehicles 712A, 712B and a DTC system 716, a travel-priority conflict zone 720, an intersection-based communication device/sensor 724, and a central coordinator 728. In this example, queues 704 and 712 can approach zone 720 and perform the previously described methods using DTC systems 708 and 716 in order to begin resolution of a travel-priority conflict by establishing a DTCP, as described above.

However, in addition to the previously described examples, the present example is an extension of the above-described methods and can not only resolve priority conflicts on a conflict zone by conflict zone basis, but also optimize traffic flow over a geographic area containing many actual, anticipated, or potential travel priority conflicts. In this example, intersection-based communication device/sensor 724 can inform DTC systems 708 and 716 by providing traffic-related information or by providing recommended route information, as supplied by central coordinator 728. For example, either through communication methods described above (including beaconing and Geocasting, among others), or through information collected directly using techniques well known to those skilled in the art, intersection-based communication device/sensor 724 can gauge the degree of congestion proximate to zone 720. In this example, intersection-based communication device/sensor 724 is shown mounted on a building 732, but those skilled in the art will appreciate that the sensor can be mounted on any convenient surface or structure, including on signposts, in below-street level structures, and so forth. This information can then be communicated using any communication method known to those skilled in the art, including both wired and wireless techniques, to central coordinator 728.

Central coordinator 728, having been provided with analogous information from other travel-priority conflict zones over a geographic area containing a plurality of such zones, can provide intersection-based communication device/sensor 724 with, for example, recommended directions for some or all of the DTCP. These recommendations can then be communicated from intersection-based communication device/sensor 724 to DTC systems 708 and 716 using the techniques and methods previously described. Furthermore, central coordinator 728 can use information collected not only to provide information to a DTC system to inform its decision making process, but the central coordinator can also dictate instructions to DTC systems, thereby centralizing coordination of traffic flow. Regardless of the degree of influence central coordinator 728 exercises over one or more DTC systems, method described herein can be used in conjunction with such systems as SCADA (Supervisory Control and Data Acquisition), or other such centralized decision-making systems as used in Power Grid, Smart City or Smart Grid systems.

In a specific embodiment of this example, central coordinator 728 (which can be a SCADA system or an Operating System of a central coordinator in a Smart City context) can communicate to intersection-based communication device/sensor 724 the information that for northbound vehicles, the preferred travel option is to either continue traveling northbound or turn right within a provided number of blocks (or at a specific provided street). This then centrally coordinates traffic flow based on information available to the central coordinator and not available to an individual vehicle.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A method of coordinating vehicular traffic proximate to a potential travel-priority conflict zone, the vehicular traffic including a plurality of vehicles each including on-board a dynamic traffic control system, comprising:

communicating, by a first dynamic traffic control system of a first one of the plurality of vehicles, with at least one second dynamic traffic control system located on-board at least one second one of the plurality of vehicles proximate to the potential travel-priority conflict zone to determine whether or not a travel-priority conflict is likely to be present within the potential travel-priority conflict zone between the first one of the plurality of vehicles and the at least one second one of the plurality of vehicles;

if the travel-priority conflict is determined to be likely, then:

establishing a dynamic traffic control plan for avoiding the travel-priority conflict in the potential travel-priority conflict zone; and coordinating, via said communicating, to elect from among the plurality of vehicles a temporary coordinator vehicle responsible for temporarily coordinating the dynamic traffic control plan.

2. A method according to claim 1, wherein said communicating includes using a vehicle-to-vehicle communication system.

3. A method according to claim 2, wherein said using a vehicle-to-vehicle communication system includes using a dedicated short-range communication protocol.

4. A method according to claim 2, wherein said using a vehicle-to-vehicle communication system includes using a mobile communications device removable from the first one of the plurality of vehicles by a user.

5. A method according to claim 1, wherein said communicating includes using the first dynamic traffic control system as a transponder to facilitate vehicle-to-vehicle communication beyond the as-designed operating range of a vehicle-to-vehicle communication system.

6. A method according to claim 1, further comprising presenting an instruction from the dynamic traffic control plan to an operator of any vehicle of the plurality of vehicles.

7. A method according to claim 6, wherein said presenting the instruction includes displaying the instruction on a display built into the vehicle.

8. A method according to claim 6, wherein said presenting the instruction includes displaying the instruction on a heads-up display.

9. A method according to claim 6, wherein said presenting the instruction includes displaying the instruction on a mobile communications device.

10. A method according to claim 6, wherein said presenting the instruction includes displaying a virtual traffic signal.

11. A method according to claim 10, wherein said displaying the virtual traffic control signal includes displaying a virtual traffic light.

12. A method according to claim 10, wherein said displaying the virtual traffic control signal includes displaying a travel-directional indicator.

13. A method according to claim 6, wherein said presenting instructions includes presenting the instruction as an audible instruction.

14. A method according to claim 1, further comprising using an on-board-vehicle processor to establish the dynamic traffic control plan.

15. A method according to claim 14, wherein said using the on-board processor includes using a processor dedicated to establishing the dynamic traffic control plan and/or facilitating establishing the dynamic traffic control plan.

16. A method according to claim 1, further comprising using an on-board processor designed and configured to establish the dynamic traffic control plan and/or facilitate establishing the dynamic traffic control plan with at least one other dynamic traffic controller, and designed and configured to perform at least one other vehicular function unrelated to establishing or facilitating establishing the dynamic traffic control plan.

17. A method according to claim 1, wherein said establishing the dynamic traffic control plan includes using a travel-route database to inform the dynamic traffic control plan as to route-specific conditions.

18. A method according to claim 17, further comprising using vehicle-beaconing to anticipate a travel-priority conflict by determining a location of at least one vehicle in the context of the route-specific conditions.

19. A method according to claim 1, further comprising using data communicated by the first dynamic traffic control system to facilitate establishing the dynamic traffic control plan, the data including vehicle location.

20. A method according to claim 1, wherein said coordinating includes electing a temporary coordinator vehicle based on proximity to the potential travel-priority conflict zone.

21. A method according to claim 1, further comprising communicating with a central coordinator, the central coordinator providing traffic information to the at least one dynamic traffic control system so as to further inform the development of the dynamic traffic control plan.

22. A method according to claim 21, wherein said communicating with a central coordinator is facilitated using an intersection-based communication device/sensor.

23. A method according to claim 22, wherein said communicating includes providing traffic information to the central coordinator.

24. A method according to claim 1, wherein said communicating includes receiving instructions from a central coordinator, the instructions used by the temporary coordinator as at least a portion of the dynamic traffic control plan.

25. A machine-readable physical memory containing machine-executable instructions for performing a method of coordinating vehicular traffic proximate to a potential travel-priority conflict zone, the vehicular traffic including a plurality of vehicles each including on-board a dynamic traffic control system, said machine-executable instructions comprising:

a first set of machine-executable instructions for communicating, by a first dynamic traffic control system of a first one of the plurality of vehicles, with at least one second dynamic traffic control system located on-board at least one second one of the plurality of vehicles proximate to the potential travel-priority conflict zone so as to determine whether or not a travel-priority conflict is likely to be present within the potential travel-priority conflict zone between the first one of the plurality of vehicles and the at least one second one of the plurality of vehicles;

a second set of machine-executable instructions for establishing a dynamic traffic control plan for avoiding the travel-priority conflict in the potential travel-priority conflict zone when the travel-priority conflict is determined to be present; and a third set of machine-executable instructions for coordinating, via the communicating and when the travel-priority conflict is determined to be present, to elect from among the plurality of vehicles a temporary coordinator vehicle responsible for temporarily coordinating the dynamic traffic control plan.

26. A machine-readable physical memory according to claim 25, wherein said first set of machine-executable instructions includes machine-executable instructions for using a vehicle-to-vehicle communication system.

27. A machine-readable physical memory according to claim 26, wherein said machine-executable instructions for using the vehicle-to-vehicle communications system includes machine-executable instructions for using a dedicated short-range communication protocol.

28. A machine-readable physical memory according to claim 26, wherein said machine-executable instructions for using a vehicle-to-vehicle communications system includes machine-executable instructions for using a mobile communications device removable from the first one of the plurality of vehicles by a user.

29. A machine-readable physical memory according to claim 25, wherein said first set of machine-executable instructions includes machine-executable instructions for using the first dynamic traffic control system as a transponder to facilitate vehicle-to-vehicle communication beyond the as-designed operating range of a vehicle-to-vehicle communication system.

30. A machine-readable physical memory according to claim 25, further comprising machine-executable instructions for presenting an instruction from the dynamic traffic control plan to an operator of any vehicle of the plurality of vehicles.

31. A machine-readable physical memory according to claim 30, wherein said machine-executable instructions for presenting the instruction includes machine-executable instructions for displaying the instruction on a display built into the vehicle.

32. A machine-readable physical memory according to claim 30, wherein said machine-executable instructions for presenting the instruction includes machine-executable instructions for displaying the instruction on a heads-up display.

33. A machine-readable physical memory according to claim 30, wherein said machine-executable instructions for presenting the instruction includes machine-executable instructions for displaying the instruction on a mobile communications device.

34. A machine-readable physical memory according to claim 30, wherein said machine-executable instructions for presenting the instruction includes machine-executable instructions for displaying a virtual traffic signal.

35. A machine-readable physical memory according to claim 34, wherein said machine-executable instructions for displaying the virtual traffic control signal includes machine-executable instructions for displaying a virtual traffic light.

36. A machine-readable physical memory according to claim 34, wherein said machine-executable instructions for displaying the virtual traffic control signal includes machine-executable instructions for displaying a travel-directional indicator.

37. A machine-readable physical memory according to claim 30, wherein said machine-executable instructions for presenting instructions includes machine-executable instructions for presenting the instruction as an audible instruction.

38. A machine-readable physical memory according to claim 25, wherein said second set of machine-executable instructions includes machine-executable instructions for using a travel-route database to inform the dynamic traffic control plan as to route-specific conditions.

39. A machine-readable physical memory according to claim 38, further comprising machine-executable instructions for using vehicle-beaconing to anticipate a travel-priority conflict by determining a location of at least one vehicle in the context of the route-specific conditions.

40. A machine-readable physical memory according to claim 25, further comprising machine-executable instructions for using data communicated by the first dynamic traffic control system to facilitate establishing the dynamic traffic control plan, the data including vehicle location.

41. A machine-readable physical memory according to claim 25, wherein said first set of machine-executable instructions includes machine-executable instructions for electing a temporary coordinator vehicle based on proximity to the potential travel-priority conflict zone.

42. A machine-readable physical memory according to claim 25, further comprising a set of machine-executable instructions for communicating with a central coordinator, the central coordinator providing traffic information to the at least one dynamic traffic control system so as to further inform the development of the dynamic traffic control plan.

43. A machine-readable physical memory according to claim 42, wherein said set of machine-executable instructions for communicating with a central coordinator includes using an intersection-based communication device/sensor to facilitate the communicating.

44. A machine-readable physical memory according to claim 43, wherein said first set of machine-executable instructions includes instructions for providing traffic information to the central coordinator.

45. A machine-readable physical memory according to claim 25, wherein said first set of machine-executable instructions includes receiving travel instructions from a central coordinator, the travel instructions used by the temporary coordinator to further establish the dynamic traffic control plan.

46. A system for coordinating vehicular traffic proximate to a potential travel-priority conflict zone, the vehicular traffic including a plurality of vehicles each including on-board a dynamic traffic control system, the system comprising:

a vehicle-to-vehicle communications system on-board a first one of the plurality of vehicles;

a first dynamic traffic controller on-board the first one of the plurality of vehicles;

a processor in operative communication with said vehicle-to-vehicle communication system; and memory in operative communication with said processor, said memory containing machine-executable instructions for execution by said processor and comprising:

a first set of machine-executable instructions for communicating, by said first dynamic traffic controller of the first one of the plurality of vehicles, with at least one second dynamic traffic controller located on-board at least one second one of the plurality of vehicles proximate to the potential travel-priority conflict zone so as to determine whether or not a travel-priority conflict is likely to be present within the potential travel-priority conflict zone between the first one of the plurality of vehicles and least one second one of the plurality of vehicles;

a second set of machine-executable instructions for establishing a dynamic traffic control plan for avoiding the travel-priority conflict in the potential travel-priority conflict zone when the travel-priority conflict is determined to be present; and a third set of machine-executable instructions for coordinating, via the communicating and when the travel-priority conflict is determined to be present, to elect from among the plurality of vehicles a temporary coordinator vehicle responsible for temporarily coordinating the dynamic traffic control plan.

47. A system according to claim 46, wherein said vehicle-to-vehicle communications system includes a dedicated short range communication system.

48. A system according to claim 46, wherein said first dynamic traffic controller includes at least one mobile communications device.

49. A system according to claim 46, wherein said processor is designed and configured to be in operative communication exclusively with said first dynamic traffic controller.

50. A system according to claim 46, wherein said processor is designed and configured to establish the dynamic traffic control plan and/or facilitate establishing the dynamic traffic control plan with the at least one second dynamic traffic controller and configured to perform at least one vehicular function unrelated to establishing or facilitating establishing the dynamic traffic control plan.

51. A system according to claim 50, wherein said processor is an as-installed vehicle-based processor re-programmed to be in operative communication with said first dynamic traffic controller.

52. A system according to claim 46, wherein said first set of machine-executable instructions includes machine-executable instructions for using said vehicle-to-vehicle communication system.

53. A system according to claim 52, wherein said machine-executable instructions for using said vehicle-to-vehicle communications system includes machine-executable instructions for using a dedicated short-range communication protocol.

54. A system according to claim 46, wherein said first set of machine-executable instructions includes machine-executable instructions for using the system as a transponder to facilitate vehicle-to-vehicle communication beyond the as-designed operating range of said vehicle-to-vehicle communication system.

55. A system according to claim 46, wherein said memory further contains machine-executable instructions for presenting an instruction from the dynamic traffic control plan to an operator of the first one of the plurality of vehicles.

56. A system according to claim 55, wherein said machine-executable instructions for presenting the instruction includes machine-executable instructions for displaying the instruction on a display built into the first one of the plurality of vehicles.

57. A system according to claim 55, wherein said machine-executable instructions for presenting the instruction includes machine-executable instructions for displaying the instruction on a heads-up display.

58. A system according to claim 55, wherein said machine-executable instructions for presenting the instruction includes machine-executable instructions for displaying the instruction on a mobile communications device.

59. A system according to claim 55, wherein said machine-executable instructions for presenting the instruction includes machine-executable instructions for displaying a virtual traffic signal.

60. A system according to claim 59, wherein said machine-executable instructions for displaying the virtual traffic control signal includes machine-executable instructions for displaying a virtual traffic light.

61. A system according to claim 59, wherein said machine-executable instructions for displaying the virtual traffic control signal includes machine-executable instructions for displaying a travel-directional indicator.

62. A system according to claim 55, wherein said machine-executable instructions for presenting instructions includes machine-executable instructions for presenting the instruction as an audible instruction.

63. A system according to claim 46, wherein said second set of machine-executable instructions includes machine-executable instructions for using a travel-route database to inform the dynamic traffic control plan about route-specific conditions.

64. A system according to claim 46, wherein said memory further contains machine-executable instructions for using vehicle-beaconing to anticipate a travel-priority conflict by determining a location of at least one vehicle in the context of the route-specific conditions.

65. A system according to claim 46, wherein said memory further contains machine-executable instructions for using data communicated by the system to facilitate establishing the dynamic traffic control plan, the data including vehicle location.

66. A system according to claim 46, wherein said first set of machine-executable instructions includes machine-executable instructions for electing a temporary coordinator vehicle based on proximity to the potential travel-priority conflict zone.

67. A system according to claim 46, further comprising a central coordinator, said central coordinator in operative communication with said processor through said vehicle-to-vehicle communication system so as to further establish the dynamic traffic control plan.

68. A system according to claim 67, wherein said vehicle-to-vehicle communication system includes an intersection-based communication device/sensor.

69. A system according to claim 68, wherein the operative communication between said central coordinator and said processor includes providing traffic information to the central coordinator.

70. A system according to claim 46, wherein said second set of machine-executable instructions includes machine-executable instructions for receiving travel instructions from a central coordinator, the travel instructions used by the temporary coordinator vehicle to further establish the dynamic traffic control plan.

71. A system according to claim 46, further comprising the first one of the plurality of vehicles.

72. A system according to claim 71, further comprising a central coordinator.

73. A system according to claim 72, further comprising an intersection-based communication device/sensor.

* * * * *